US010159285B2

(12) United States Patent
Watson

(10) Patent No.: US 10,159,285 B2
(45) Date of Patent: Dec. 25, 2018

(54) VAPORIZER WITH IMPROVED VENTILATION

(71) Applicant: Zipline Innovations, LLC, Denver, CO (US)

(72) Inventor: James Matthew Watson, Katy, TX (US)

(73) Assignee: Zipline Innovations, LLC, Denver, CO (US)

( * ) Notice: Subject to any disclaimer, the term of this patent is extended or adjusted under 35 U.S.C. 154(b) by 112 days.

(21) Appl. No.: 15/475,455

(22) Filed: Mar. 31, 2017

(65) Prior Publication Data

US 2018/0279674 A1 Oct. 4, 2018

(51) Int. Cl.
*A24F 47/00* (2006.01)
*A24F 7/02* (2006.01)

(52) U.S. Cl.
CPC ..... *A24F 47/008* (2013.01); *A24F 7/02* (2013.01)

(58) Field of Classification Search
CPC ..... A24F 47/008
See application file for complete search history.

(56) References Cited

U.S. PATENT DOCUMENTS

| | | | | |
|---|---|---|---|---|
| 4,945,928 | A * | 8/1990 | Rose | A24B 15/165 131/270 |
| 2016/0235121 | A1* | 8/2016 | Rogan | A24D 3/041 |
| 2016/0366947 | A1* | 12/2016 | Monsees | H05B 3/04 |
| 2016/0374399 | A1* | 12/2016 | Monsees | A24F 47/008 131/329 |
| 2017/0295845 | A1* | 10/2017 | Bajpai | A24F 47/008 |
| 2018/0014574 | A1* | 1/2018 | Rogan | H05B 6/108 |
| 2018/0146715 | A1* | 5/2018 | Takeuchi | A24F 47/00 |
| 2018/0255831 | A1* | 9/2018 | Lipowicz | A24F 47/008 |

* cited by examiner

*Primary Examiner* — James Harvey
(74) *Attorney, Agent, or Firm* — Seyfarth Shaw LLP

(57) ABSTRACT

Disclosed is a tip and a corresponding vaporizer with improved ventilation. The vaporizer can include a mouthpiece and, at an opposite end, a vent opening that allows for better ventilation of the vaporizer and improved comfort and flavor during use. The vaporizer tip can also include holes that allow air to flow inside the tip and around the coil to further improve ventilation and comfort of use.

17 Claims, 7 Drawing Sheets

VAPORIZER WITH IMPROVED VENTILATION

TECHNICAL FIELD OF THE INVENTION

The present application relates generally to vaporizers. More particularly, the present application relates to vaporizers and tips with improved ventilation.

BACKGROUND OF THE INVENTION

Vaporizers are a well-known means of smoking an herbal product, such as a concentrate. A user can press a button to heat a coil to a temperature whereby the product is heated and active ingredients in the product are converted to a vapor that the user can inhale. Vaporizers are thought to be a more healthy way of smoking the product because the coil can heat to a temperature sufficient to combust mainly the active ingredients without significantly combusting other parts of the product that would produce carcinogens.

Various tips are used to heat herbal products prior to consumption. For example, vaporizer or atomizer tips can be removably coupled to a body of a vaporizer and activated to heat the product. The tips receive air from holes in the body of the vaporizer to allow air flow within the vaporizer over the tip and through the mouthpiece. For example, a user could activate a tip, heat the product, and allow the heated vapor to flow upward based on the flow of gas through the side holes.

SUMMARY OF THE INVENTION

The presently disclosed embodiments relate to a tip and a corresponding vaporizer that allow better air flow and improved user experience during use. For example, at least some of the presently disclosed embodiments allow for a mouthpiece at one end where a user can inhale and consume a heated product, and a vent opening at the opposite end for better ventilating the vaporizer during use. In at least some embodiments, the vaporizer tip itself can include holes that allow air to flow inside the tip and around the coil to further improve ventilation and create a more comfortable draw for the user of the vaporizer.

The vent opening on the opposite end of the mouthpiece, and/or the holes in the tip itself, improve ventilation of the vaporizer and allow an easier draw by the user. The improved ventilation also allows the user to pull product vapors through the center of the tip which keeps the product cooler and improves the flavor of the product during initial and subsequent consumptions.

For example, the presently disclosed embodiments include a vaporizer having first and second ends and including a body, a vent hole defined within the first end, a cap having a mouthpiece that is located opposite the first end and including an orifice, and a power source disposed within the body. A tip is coupled to the body and includes a heating element that can be activated by the power source upon selective activation by a user. The vent hole and mouthpiece define opposite ends of a ventilation path that allows air to flow from the vent hole, through the body and cap, and out through the mouthpiece.

Further disclosed is a vaporizer tip including a base, a heating element disposed within the base and having a central axis extending longitudinally through the heating element, and an opening directing a ventilation path into the base and through at least the central axis of the heating element.

Also described is a method of using a vaporizer including removing a cap with a mouthpiece from a body, contacting the tip against a product to be consumed, placing the cap onto the body, and activating a heating element in a tip. The product can then be inhaled, causing air to flow in a ventilation path from a first end of the vaporizer through the body and cap of the vaporizer and out through the mouthpiece.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION OF THE EMBODIMENTS

Figure 1:
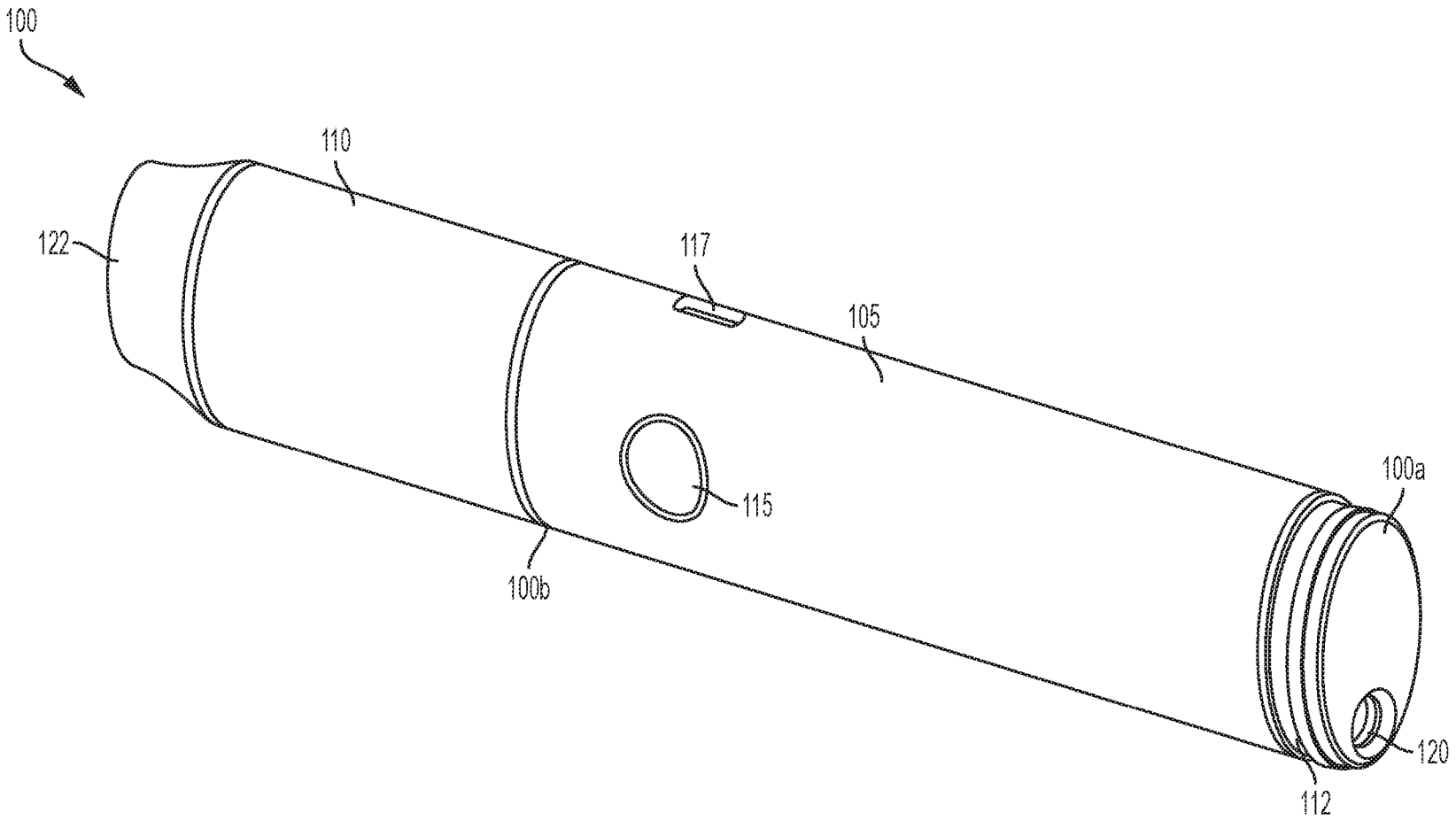
FIG. 1 is a front perspective view of a vaporizer according to at least some of the presently disclosed embodiments.

While this invention is susceptible of embodiments in many different forms, there is shown in the drawings, and will herein be described in detail, a preferred embodiment of the invention with the understanding that the present disclosure is to be considered as an exemplification of the principles of the invention and is not intended to limit the broad aspect of the invention to embodiments illustrated. As used herein, the term "present invention" is not intended to limit the scope of the claimed invention and is instead a term used to discuss exemplary embodiments of the invention for explanatory purposes only.

The presently disclosed embodiments include a vaporizer and tip with less air restriction and improved air flow during use. The tip can be implemented in a vaporizer with a mouthpiece at one end and a vent opening at the opposite end for better ventilation. The vaporizer tip itself can include holes that allow air to flow inside a central portion of the tip to further improve ventilation, flavor, and ease of use.

Figure 2:
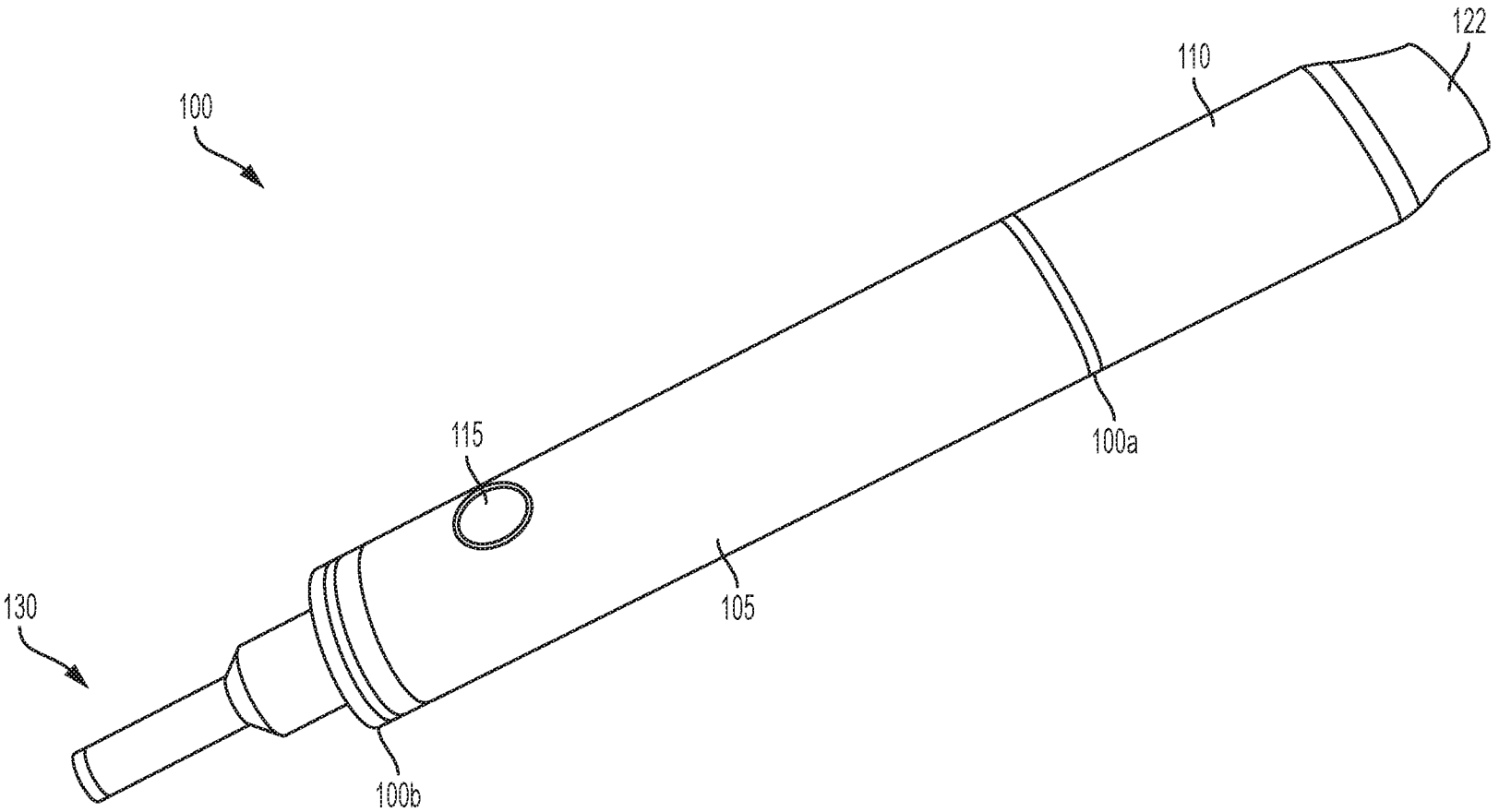
FIG. 2 is a front perspective view of a vaporizer with the cap removed according to at least some of the presently disclosed embodiments.

As shown in FIGS. 1 and 2, a vaporizer 100 can include a body 105 that serves as the structural backbone of the vaporizer 100 and a cap 110 to cover an end of the body 105. The body 105 can include first 100*a* and second 100*b* ends, with a rim 112 located on the first end 100*a* to receive the cap 110 when the cap 110 is removed from the second end

100*b*, for example, during use. In this manner, the cap 110 can be coupled to the vaporizer 100 and is less likely to be lost by the user during use.

The vaporizer 100 can include a power button 115 that can be activated by a user to cause the powering of a heating element, such as a coil, that heats a product, as discussed below in more detail. In at least some embodiments, the power button 115 can be pushed to provide power to the coil, and when the user removes their finger from the power button 115, power will immediately cease to flow to the coil so that the coil can cool. The power facilitated by the power button can come from a variety of sources, for example, a battery or electrical socket. In at least some embodiments, the vaporizer 100 can include a charging port 117 that couples to a power adapter to charge the battery of the vaporizer 100.

In at least some of the presently disclosed embodiments, the vaporizer 100 is better ventilated as compared to existing vaporizers due to one or more air holes provided at or near the first 100*a* and second 100*b* ends. The vaporizer 100 can include an air hole 120 located at or near the first end 100*a*, and a mouthpiece 122 with its corresponding hole at the second end 100*b*. As shown in FIG. 2, a tip 130 can also be located near or at the second end 100*b* where the user can contact the tip 130 against a product and activate the power button 115 to heat the tip 130 with a coil or other known means. The air hole 120 therefore begins a ventilation path that ends at the orifice of the mouthpiece when the user inhales the product. The ventilation path provides air from the air hole 120, through the body 105 and cap 110, and out through the orifice of the mouthpiece 122. In some embodiments, the ventilation path flows through the tip 130 itself through holes that direct the ventilation path through the central axial portion of the coil that heats the product.

The mouthpiece 122 can include an orifice through which a user can inhale product, as is well known in the art. The mouthpiece 122 can be removably couplable to the body 105 or, as discussed below, at an opposite end of the vaporizer 100. The mouthpiece 122 can further be curved to ergonomically fit the lips or mouth of the user.

The ventilation of the vaporizer 100 from the air hole 120 to the mouth piece 122 allows air to flow directly through the vaporizer 100, for example, in a substantially linear manner, rather than only flowing into the vaporizer 100 through side holes. This ventilation allows an improved user experience by requiring less energy from the user to inhale the heated product due to the improved ventilation and airflow from the air hole 120 over the tip 130 and out of the mouthpiece 122. The additional ventilation can also allow the product to stay cooler during heating, providing a better taste of the product as compared to those vaporizers with less ventilation. As discussed below in more detail, the tip 130 itself can include air holes that allow for ventilation through the center of the tip 130 and through the central axis of the coil (i.e., the longitudinal axis of the tip). While not all embodiments of the present invention require the tip 130 to be so constructed, such a tip could improve ventilation and user experience.

Figure 3:
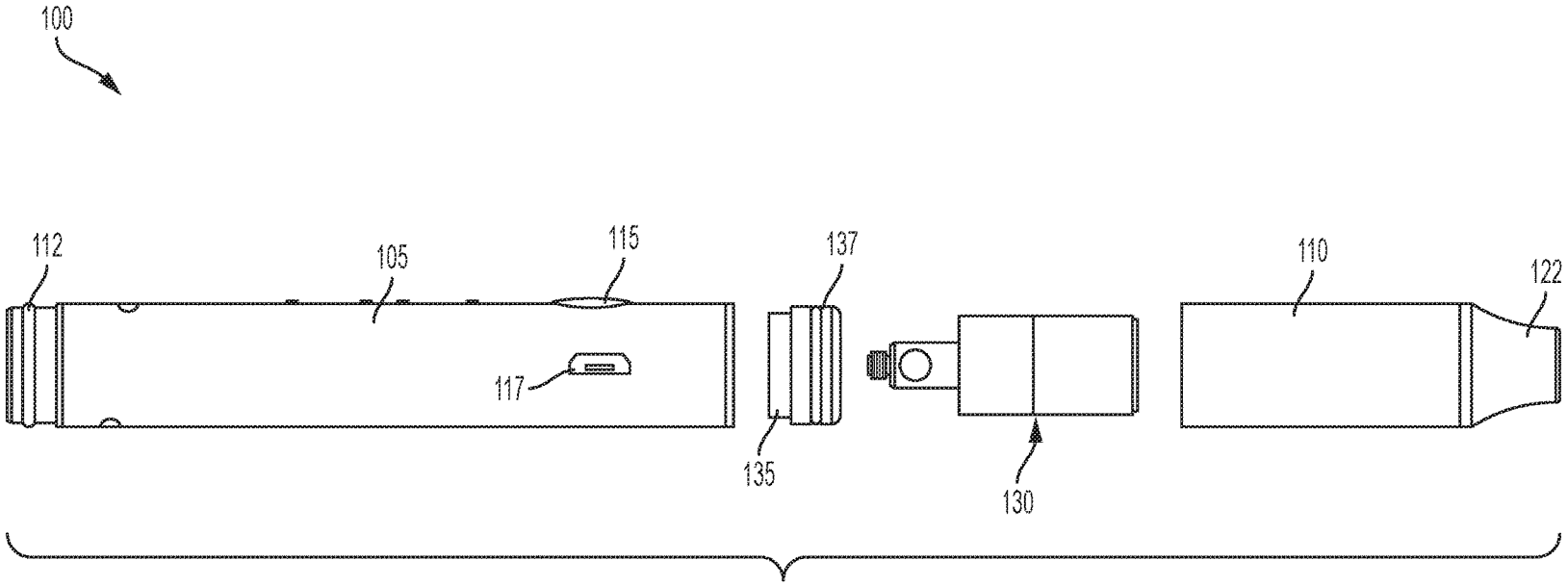
FIG. 3 is an exploded front view of a vaporizer according to at least some of the presently disclosed embodiments.

The vaporizer 100 can also include a reclaim chamber 135 that can receive unused product that flows from the tip 130, or elsewhere, during use. The reclaim chamber 135 can be shaped with a cross-section corresponding to that of the body 105 and cap 110 and can receive the cap 110 while the vaporizer 100 is not being used (i.e., as shown in FIG. 3). For example, and without limitation, the cap 110 can insert onto the reclaim chamber 135 via an O-ring 137 that frictionally engages the cap 110 when inserted. Because the O-ring can be made from a rubbery or otherwise compressible material, the cap 110 can frictionally engage the O-ring 137 to removably stay in place. Note that the configuration shown in FIG. 3, where the cap 130 can be coupled to the reclaim chamber 135, is the opposite of FIG. 2, where the vaporizer 100 is being used and the cap 110 is coupled to the rim 112.

Figure 4:
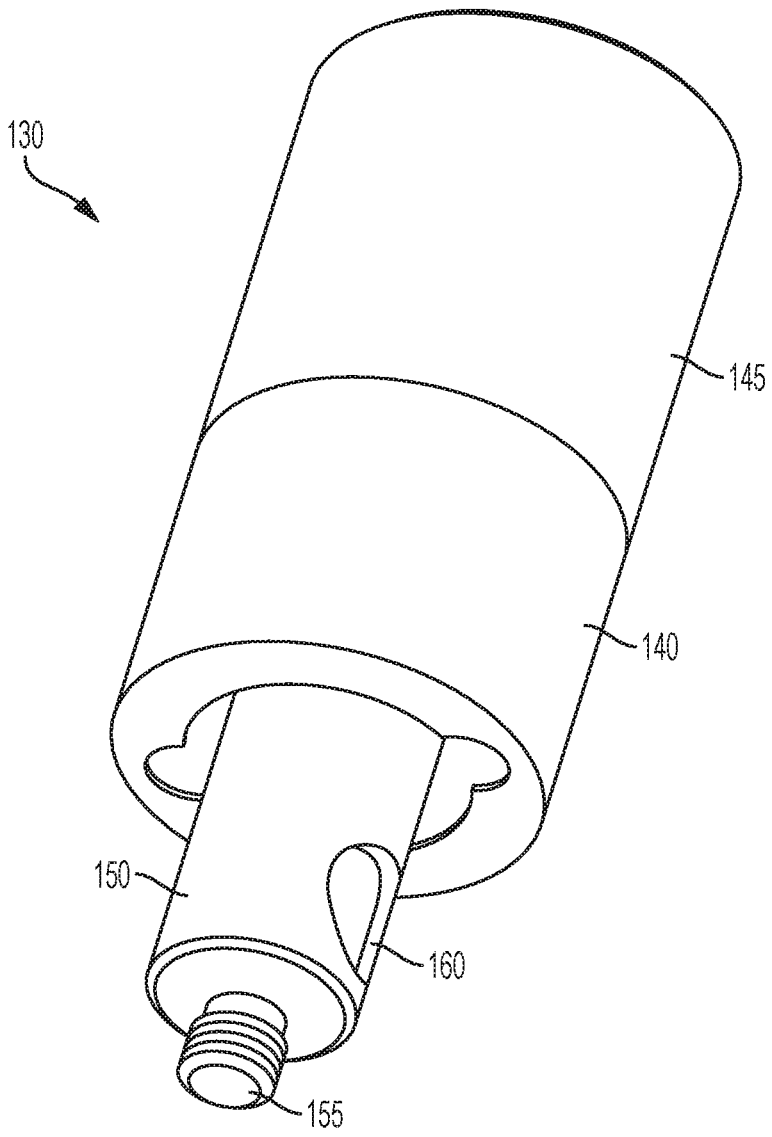
FIG. 4 is a bottom perspective view of a vaporizer tip according to at least some of the presently disclosed embodiments.
Figure 5:
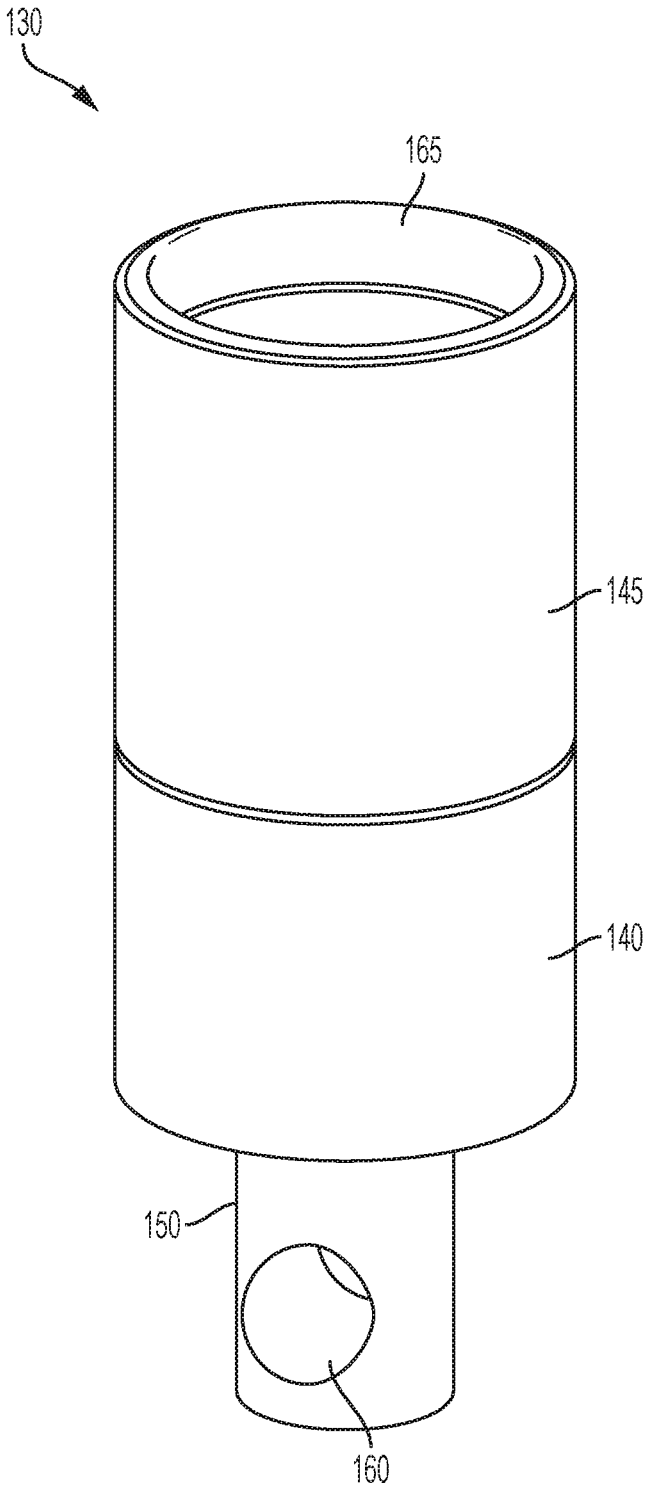
FIG. 5 is a top perspective view of a vaporizer tip according to at least some of the presently disclosed embodiments.

FIGS. 4 and 5 illustrate a tip 130 according to at least some of the presently disclosed embodiments. As discussed previously, the tip 130 is used for heating and combusting product to be consumed by a user. The tip 130 can include a base 140 coupled to a barrel 145, with a stem 150 connecting the tip 130 to the body 105. For example, the tip 130 can include tip threads 155 that couple the tip 130 to threads of the body 105, as discussed below in more detail. The tip 130 can also include an opening 160 for allowing air to pass into the tip 130 and through the coils of the tip where product can be heated and combusted. The opening 160 can be located on the side of the stem 150 as shown in FIG. 4, and can provide the necessary ventilation to allow air to better flow through the tip 130 and into the user's mouth. As shown in FIG. 5, the tip 130 can include a chamber 165 for receiving product and heating it within the chamber 165 with a coil or other heating component. The air can therefore flow into the air hole 120 of the vaporizer 100, through the opening 160 of the tip 130, through at least the interior central portion of the coil within the tip, and out through the chamber 165. Of course, other air can flow around the tip 130 when a user sucks on the mouthpiece 122.

As shown, the chamber 165 can be an indented structure that receives the product for consumption. However, the chamber 165 is not so limited, and can be any shape without deviating from the spirit and scope of the present invention. For example, the chamber 145 can be an elongated tube that extends from the base 140 of the tip 130 rather than an indented structure. The chamber 145 can also be a structure with more surface area to better collect the product upon insertion.

Figure 6:
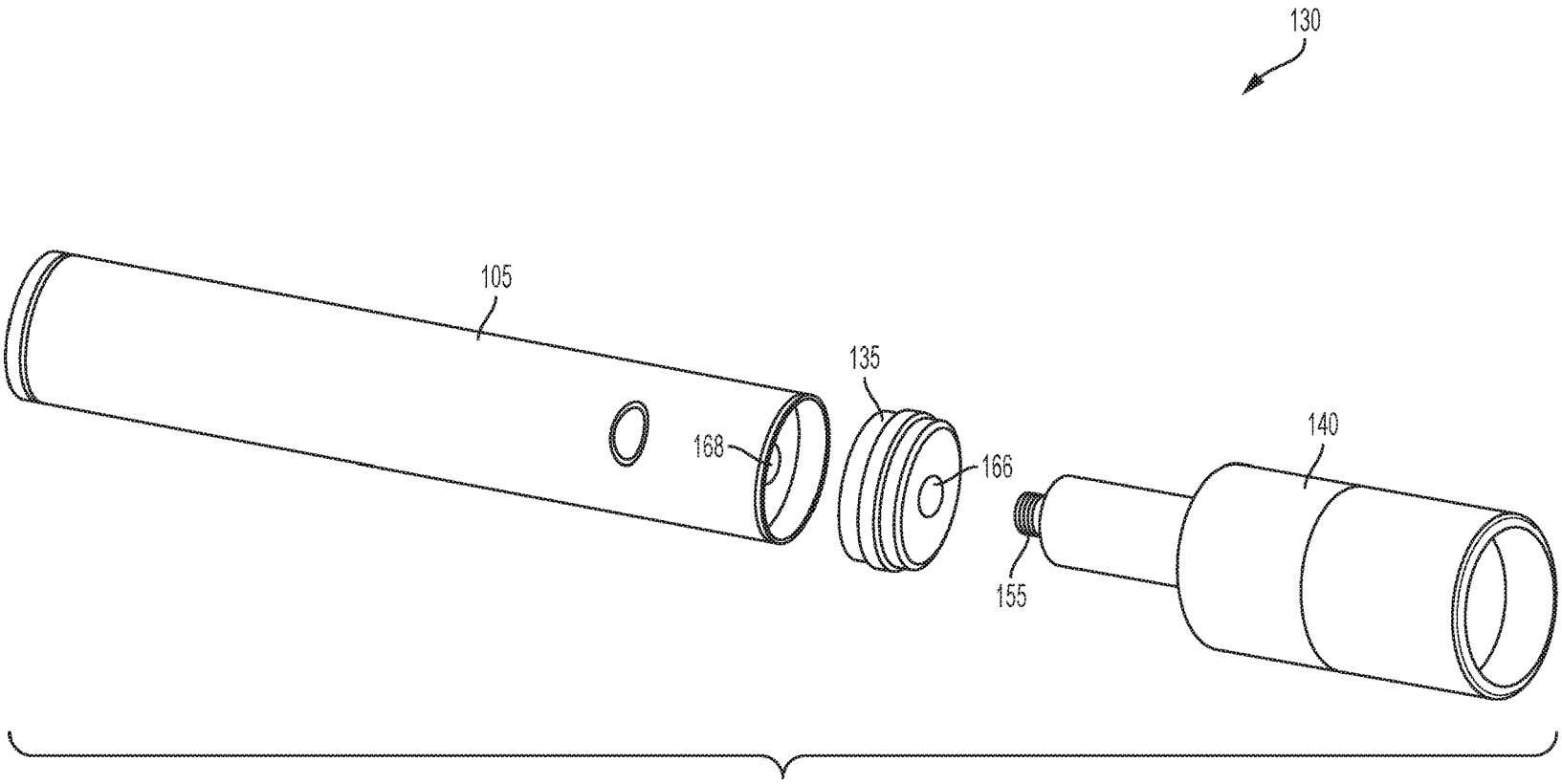
FIG. 6 is a partial exploded front view of a vaporizer according to at least some of the presently disclosed embodiments.

As shown in FIG. 6, the reclaim chamber 135 can insert into the body 105, and the tip 130 can insert through a reclaim opening 166 in the reclaim chamber 135 and couple with body threads 168. For example, the tip threads 155 can couple with body threads 168, with the stem 150 of the tip 130 extending through the reclaim opening 166 and the base 140 of the tip 130 being larger in cross-sectional area than the cross-sectional area of the reclaim opening 166, the cross-sectional area being measured perpendicular to the longitudinal axis of the tip 130. This structure allows for the reclaim chamber 135 to be passively inserted into the body 105, and relative size of the base 140 and reclaim opening 166 to couple the reclaim chamber 135 to the body 105 when the tip threads 155 couple to the body threads 168. When a user wishes to retrieve the content within the reclaim chamber, the user can simply unscrew the tip 130 from the body 105 and remove the reclaim chamber 135 to gain access to the internal contents of the reclaim chamber 135.

Figure 7:
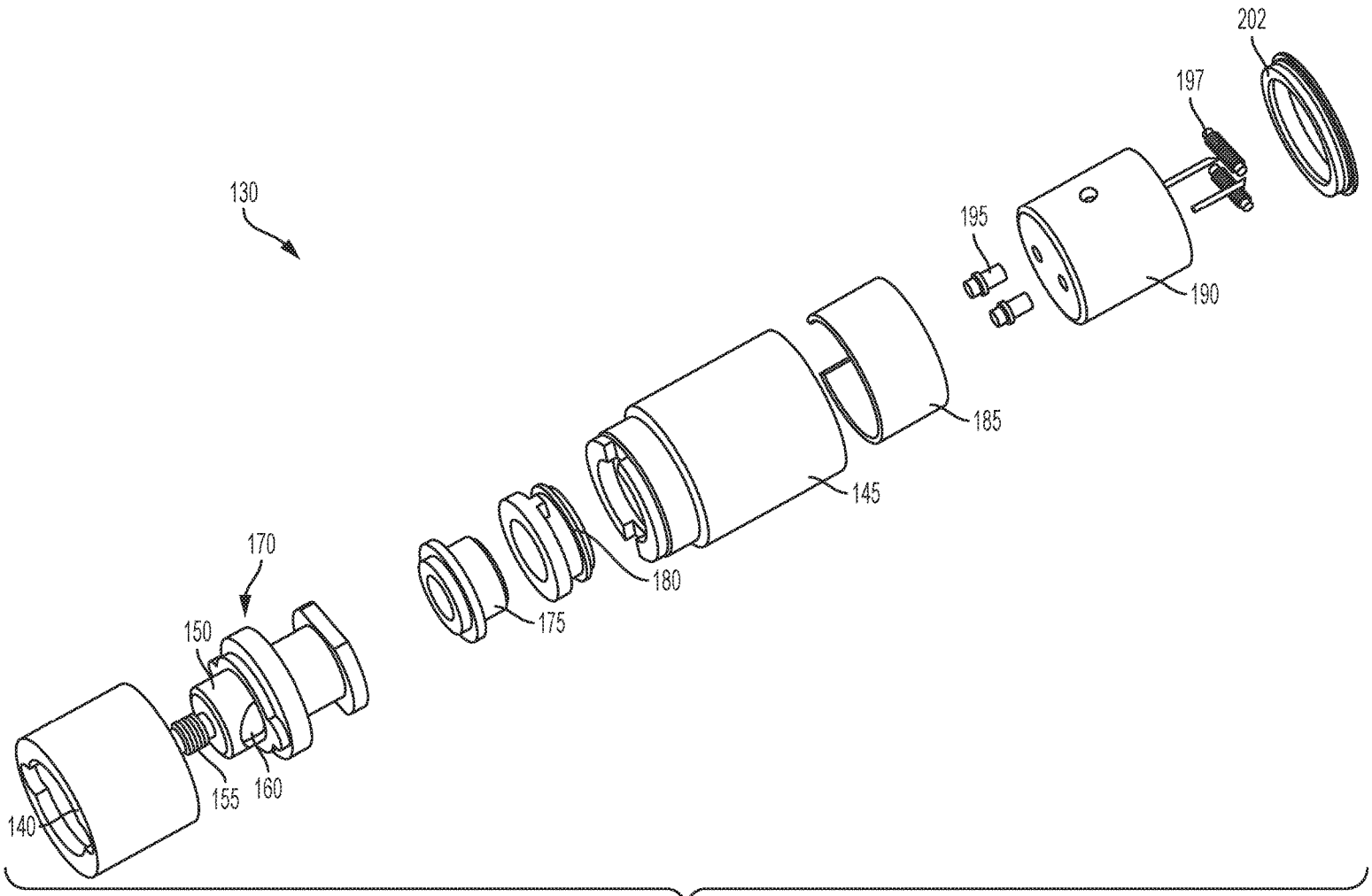
FIG. 7 is an exploded front view of a vaporizer tip according to at least some of the presently disclosed embodiments.

FIG. 7 illustrates an exploded view of a tip according to at least some of the presently disclosed embodiments. As shown, and as discussed in part above, the tip 130 can include a base 140 that inserts into a first electrode 170 (for example, a positive electrode) that itself contains the stem 150, tip threads 155, and opening 160. The first electrode 170 can couple to a first pole 175, and the first pole 175 can couple to a gel portion 180 to sufficiently connect the barrel 145 to the body 140. A screen 185, for example a nickel screen 185, can be inserted within the barrel 145 and extend around a quartz cup 190. Electrode pole tubes 195 can then extend into the quartz cup 190, where coils 197 can be located. The tip 130 assembly can be finished with a ring 202 for improved aesthetic appearance.

As discussed herein, the presently disclosed embodiments can be used with a quartz crystal atomizer to combust the product being consumed. However, any type of tip can be implemented without departing from the spirit and scope of the present invention. For example, a ceramic atomizer or standard vaporizer tip could be implemented with the inventive concepts discussed throughout this specification.

The presently disclosed embodiments have also been described with reference to a coil as the heating element. However, any heating element can be implemented without departing from the spirit and scope of the present invention. For example, and without limitation, the heating element can be a coil, flame, energized surface, or any other structure that is capable of heating the product.

As used herein, the term "coupled" and its functional equivalents are not intended to necessarily be limited to direct, mechanical coupling of two or more components. Instead, the term "coupled" and its functional equivalents are intended to mean any direct or indirect mechanical, electrical, or chemical connection between two or more objects, features, work pieces, and/or environmental matter. "Coupled" is also intended to mean, in some examples, one object being integral with another object.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of the inventors' contribution. The actual scope of the protection sought is intended to be defined in the following claims when viewed in their proper perspective based on the prior art.

What is claimed is:

1. A vaporizer comprising:

a body having opposing first and second ends;

a power source disposed within the body;

an air hole defined within the body at the first end;

a tip coupled to the body proximate the second end, the tip having a heating element capable of being activated by the power source upon selective activation by a user, the tip further including an opening fluidly communicating with the air hole through the body; and a cap having a mouthpiece, the mouthpiece being disposed proximate the second end and including an orifice adapted to receive suction to obtain gases or vapors from the tip.

2. A method of using a vaporizer comprising:

removing a cap from a body, the cap having a mouthpiece;

contacting a tip of the vaporizer against a product to be consumed;

placing the cap onto the body;

activating a heating element in the tip;

inhaling the product, causing air to flow in a ventilation path from a first end of the vaporizer through the body and cap of the vaporizer and out through the mouthpiece; and causing the ventilation path to flow through an opening in the tip such that the ventilation path flows through a central axis of the heating element.

3. The vaporizer of claim 1, wherein the opening directs at least part of the ventilation path through a central axis of the heating element.

4. The vaporizer of claim 1, wherein the tip further comprises a stem, and wherein the opening is defined within the stem.

5. The vaporizer of claim 1, further comprising a reclaim chamber coupled to the body, the reclaim chamber having a reclaim opening and the tip having a base, a cross-sectional area of the reclaim opening being smaller than a cross-sectional area of the base.

6. The vaporizer of claim 5, wherein the tip includes tip threads and the body includes body threads, and wherein the tip threads couple to the body threads to couple the reclaim chamber between the tip and the body.

7. The vaporizer of claim 1, wherein the tip includes a stem and tip threads, and wherein the tip threads are disposed on an end of the stem.

8. The vaporizer of claim 1, further comprising a rim adapted to removably receive the cap.

9. The vaporizer of claim 1, wherein the tip is a quartz crystal atomizer tip.

10. The vaporizer of claim 1, further comprising a reclaim chamber coupled to the body, the reclaim chamber including an O-ring adapted to removably receive the cap.

11. The vaporizer tip of claim 1, wherein the heating element is a coil.

12. A vaporizer tip comprising:

a base;

a heating element disposed within the base, the heating element having a central axis extending longitudinally through the heating element;

an opening directing a ventilation path into the base and through at least the central axis of the heating element; and a stem coupled to the base, the stem including tip threads adapted to couple to threads of a vaporizer body to couple a reclaim chamber to the vaporizer tip.

13. The vaporizer tip of claim 12, wherein the heating element is a coil and wherein the central axis is through the central longitudinal axis of the coil.

14. The vaporizer tip of claim 12, wherein the stem has the opening defined therein.

15. The method of claim 2, further comprising removably coupling the cap to a rim of the vaporizer.

16. The method of claim 2, further comprising decoupling the tip from the body, thereby allowing the removal of a reclaim chamber.

17. The method of claim 16, further comprising recoupling the tip to the body to thereby couple the reclaim chamber therebetween.

* * * * *